US008522364B2

(12) United States Patent
O'Brien

(10) Patent No.: US 8,522,364 B2
(45) Date of Patent: Sep. 3, 2013

(54) LIFT SUPPORT GARMENT SYSTEM

(76) Inventor: Milton O'Brien, San Francisco, CA (US)

( * ) Notice: Subject to any disclaimer, the term of this patent is extended or adjusted under 35 U.S.C. 154(b) by 258 days.

(21) Appl. No.: 13/167,735

(22) Filed: Jun. 24, 2011

(65) Prior Publication Data

US 2012/0324630 A1 Dec. 27, 2012

(51) Int. Cl.
*A41D 1/06* (2006.01)

(52) U.S. Cl.
USPC ..... 2/227; 2/236

(58) Field of Classification Search
USPC ..... 2/227, 228, 230, 236, 237, 238, 69, 2/78.1, 78.4, 79, 80, 83, 217, 220, 114, 400–404, 2/300, 312, 338, 271; 128/873, 876
See application file for complete search history.

(56) References Cited

U.S. PATENT DOCUMENTS

| | | | | |
|---|---|---|---|---|
| 863,716 | A * | 8/1907 | Hunter | 2/237 |
| 4,282,608 | A * | 8/1981 | Amberg | 2/227 |
| 4,599,750 | A * | 7/1986 | Rahaman | 2/243.1 |
| 4,800,594 | A * | 1/1989 | Young | 2/237 |
| 5,361,418 | A * | 11/1994 | Luzenske | 2/338 |
| 5,566,397 | A * | 10/1996 | Scott | 2/338 |
| 6,101,634 | A * | 8/2000 | Martinez | 2/238 |
| 6,167,572 | B1 * | 1/2001 | Naumovitz | 2/227 |
| 6,230,329 | B1 * | 5/2001 | Jennings | 2/114 |
| 6,343,383 | B1 * | 2/2002 | Madorma-Williams | 2/227 |
| 2002/0042942 | A1 * | 4/2002 | Colorado | 2/230 |
| 2004/0133963 | A1 * | 7/2004 | Jennings | 2/114 |
| 2009/0144876 | A1 * | 6/2009 | Pena et al. | 2/102 |

* cited by examiner

*Primary Examiner* — Amy Vanatta
(74) *Attorney, Agent, or Firm* — Nwamu, P.C.; Fidel D. Nwamu

(57) ABSTRACT

A garment system enabling helpers or care givers to provide physical assistance to elderly or handicapped persons and the like. The garment system includes a pair of pants, front straps, back straps, side support straps and an inner lining attached to the interior of said pants.

14 Claims, 6 Drawing Sheets

LIFT SUPPORT GARMENT SYSTEM

BACKGROUND OF THE INVENTION

The present invention relates generally to lift support garment systems and more specifically to lift support garment systems for providing physical assistance to persons with limited or no mobility.

Our average life expectancy is increasing as better nutrition and health care continue to become available. And so, with this increased life expectancy, the population of elderly individuals with limited mobility is rising.

Such elderly individuals might be parents, grandparents and other like family members that more often than not require physical assistance to move or relocate from one location to another. As an example, a grandparent might require assistance to relocate from a living room to the bedroom at bedtime.

Limited mobility is not only associated with elderly persons. Handicapped persons, for example, frequently need assistance getting in and out of a wheelchair. When a caregiver or helper renders assistance to the elderly or handicapped person, the caregiver often grabs an article of regular clothing worn by the person to whom assistance is being rendered.

Such regular clothing articles are sometimes torn when grasped by a caregiver or helper subjecting the elderly or handicapped person to injury. As a result, the caregiver or helper might attempt to support a falling elderly or handicapped person further subjecting the caregiver or helper to injury.

In other instances, if the article of regular clothing does not tear, the clothing might apply localized pressure to those areas of the body being supported during relocation causing either discomfort or injury to the elderly or handicapped person. As an example, when pants worn by an elderly or handicapped person are grasped to lift the individual, the pants might form a wedgie between the buttocks causing pain and discomfort to the buttocks area.

There is a need to address one or more of the foregoing disadvantages of conventional systems and methods, and the present invention meets this need.

BRIEF SUMMARY OF THE INVENTION

Various aspects of a garment system for aiding a person that needs assistance with physical movement can be found in exemplary embodiments of the present invention. The person needing assistance might be an elderly or handicapped person, for example.

In a first embodiment, the garment system includes a pair of pants having a waistband around the waist area of the pants. The waistband might include a front strap attached to the front portion of the waistband, the front strap extending horizontally along the front portion of the waistband.

A back strap that also extends horizontally might be secured to the back area of the waistband, the position of the back strap corresponding to but oppositely disposed to that of the front strap. The straps might be made of reinforced material that is not susceptible to tearing, and the straps are preferably attached to the waistband via double stitching.

A plurality of side straps are also fixedly attached to the sides of the pants. Specifically, in one embodiment, a first side strap, elongated and extending downwardly might be attached to a hip area of the pants. A second side strap extending downwardly might also be attached to the oppositely disposed hip area.

In another embodiment, the first side strap is attached to the side of the waistband. Here, the first strap might be elongated, extending horizontally and sidewardly along the waistband side. The second side strap extending horizontally and sidewardly is attached to an oppositely disposed side of the waistband. The garment system may also include an interior lining attached to the interior of said pants.

In this manner, when a caregiver or helper renders assistance to the elderly or handicapped person, the caregiver can grasp the straps attached to pants worn by the person to whom assistance is being rendered. The article of clothing itself worn by an elderly or handicapped person need not be grasped as in conventional systems.

Among other advantages, the present invention enables a caregiver or helper to provide physical assistance without subjecting the elderly or handicapped person to injury. A wedgie in the buttocks area is avoided, and localized pressure is not applied to areas of the body being supported during relocation thus avoiding discomfort and injury to elderly or handicapped persons.

A further understanding of the nature and advantages of the present invention herein may be realized by reference to the remaining portions of the specification and the attached drawings. Further features and advantages of the present invention as well as the structure and operation of various embodiments of the present invention are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 1A:
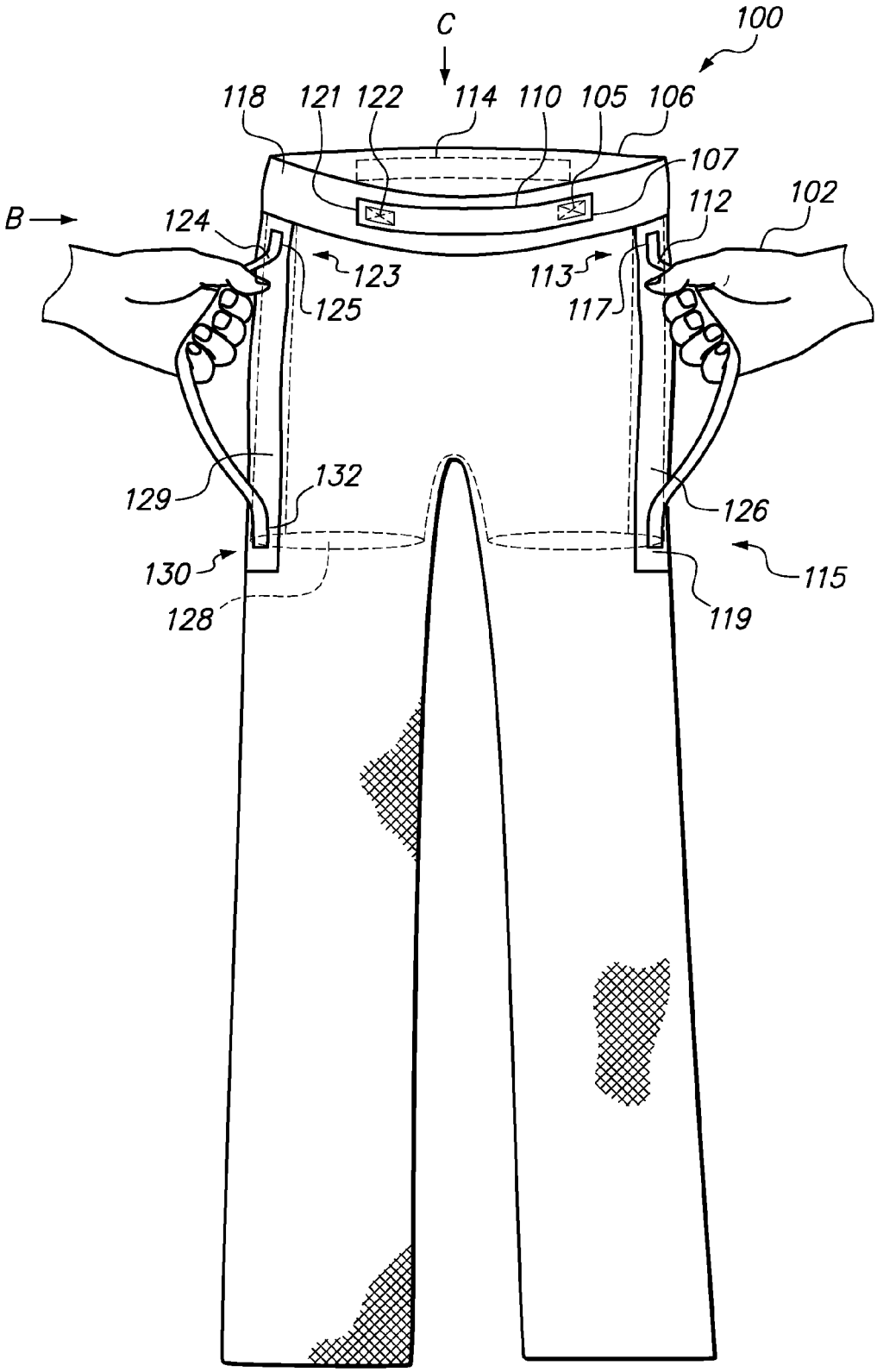
FIG. 1A illustrates a garment system according to an exemplary embodiment of the present invention.

FIG. 1A illustrates garment system 100 according to an exemplary embodiment of the present invention.

In FIG. 1A, among other components, garment system 100 comprises pants 106 having waistband 118. Waistband 118 might itself consist of elastomeric material for retaining pants 106 around a user's waist. Pants 106 can be a garment worn by a user, said garment being made of cotton, wool or other comfortable fabric or other type of material that a user can wear daily around the home or like.

In FIG. 1A, garment system 100 further comprises front strap 110 and back strap 114 (shown as hatched lines and further illustrated with reference to FIGS. 1B and 1C). Front strap 110 is centered and securely attached to a front area of waistband 118. Likewise, back strap 114 is centered and securely attached to a back area of waistband 118.

Here, each one of front strap 110 and back strap 114 can be grasped by user helper 102 (e.g. a family member or caregiver) to provide physical assistance to move or to relocate an elderly or handicapped person wearing garment system 100 from one location to another. Although reference has been made to an elderly or handicapped person, the present invention is applicable to persons with little or no mobility that require assistance in order to relocate or move from one location to another.

As shown, front strap 110 has two ends namely first end 121 and a second end 107. First end 121 is securely affixed to waistband 118 via stitching 122 and second end 107 is attached to waistband 118 via stitching 105, as shown.

In FIG. 1A, front strap 110 is elongated and extends horizontally and sidewardly between first end 121 and second end 107 along the front area of waistband 118. Back strap 114 is similarly elongated and disposed along the back area of waistband 118. Note that the positions of back strap 114 and front strap 110 are substantially aligned. Back strap 114 also extends horizontally and sidewardly along the back portion of waistband 118.

Each strap is spaced between the first and the second end so that an average-sized adult hand can grasp onto each strap. Specifically, front strap 110 is spaced between first end 121 and second end 107 for easy grasping. An exemplary length of front strap 110 and back strap 114 is approximately 6.5 inches for size 8 pants (for women). An exemplary breadth for the straps is approximately 1.25 inches for size 8 pants.

Note strap 110 and 114 dimensions are similar and are dependent upon the pants size employed. Each of front strap 110 and back strap 114 is comprised of reinforced cotton fiber, the strength of which can withstand shear stress and lateral forces directed at front strap 110 and back strap 114 by the weight of an elderly or handicapped individual during movement.

Although not illustrated, one skilled in the art will realize that the aforementioned provided dimensions of garment system 100 are exemplary. As can be seen in FIG. 1B, user helper 102 can grasp front strap 110 as well as back strap 114. Front strap 110 and back strap 114 are spaced apart in that first end 121 and second end 107 of front strap 110 are not contiguous or in contact with back strap 114.

Waistband 118, front strap 110 and back strap 114 work cooperatively and can withstand lateral and shear forces directed at the straps when user helper 102 provides physical assistance to an elderly or handicapped person. In addition to front strap 110 and back strap 114, garment system 100 also includes additional straps provided on the sides of pants 106.

In FIG. 1A, specifically, garment system 100 further comprises side strap 112 and side strap 124 attached to the sides of pants 106. Each of side strap 112 and side strap 124 extends in a downward and vertical direction along the sides of pants 106. As shown in FIG. 1A, user helper 102 can grasp side strap 112 and side strap 124 to lift an elderly or handicapped person wearing garment system 100.

The length or dimensions of each side strap 112 and side strap 124 is again dependent on the size of pants 106. For example, for size 8 pants, an exemplary length of side strap 112 and side strap 124 is 7 inches.

First end 113 of side strap 112 is attached via double stitching 117 to the side area of pants 106. A second end 115 of side strap 112 is attached to pants 106 via double stitching 119. Similarly, first end 123 of side strap 124 is attached via double stitching 125 to the side area of pants 106. A second end 130 of side strap 124 is attached to pants 106 via double stitching 132. Each strap is spaced between its first and the second end so that an average-sized adult hand can grasp onto each strap.

In one embodiment, each of side strap 112 and side strap 124 is located so that a midpoint of each side strap is substantially equidistant to front strap 110 and back strap 114. A midpoint might be located at a distance that is one-half the length of each side strap. The midpoint for side strap 112 might be located halfway between first end 113 and second end 115 of side strap 112. This midpoint is equidistant to second end 107 of front strap 110 and to the proximal end of back strap 114. In this manner, the present invention permits lateral and shear forces to be distributed across the straps.

In FIG. 1A, garment system 100 further comprises reinforced material 126 and reinforced material 129 to which side straps 112 and 124, respectively, are attached. Reinforced materials 126 and 129 are elongated extending downwardly along the side of pants 106.

Reinforced materials 126 and 129 ensure that user helper 102 can use garment system 100 to provide physical assistance to elderly or handicapped persons without tearing or ripping the straps from pants 106 thus avoiding the risk of injury to such elderly or handicapped persons. That is, by using side strap 112 and, side strap 124 attached by reinforcement to materials 126 and 129, user helper 102 is provided with support holdings that enable safe and reliable movement and relocation of an elderly or handicapped person.

In FIG. 1A, garment system 100 also includes interior lining 128 that is preferably made of a mesh and breathable material. Other materials consistent with the spirit and scope of the present invention can be utilized.

Here, interior lining 128 is attached to the inside area of waistband 118. Specifically, interior lining 128 extends from the upper edge of waistband 118 to immediately below the hip area of pants 106. Interior lining 128 is also contiguous around the interior front, side and back portions of pants 106.

In FIG. 1A, interior lining 128 is affixed to sides of pants 106 as well as to waistband 118. Specifically, interior lining 128 is attached to a first side of pants 106 by stitching 117 and stitching 119. Note that stitching 117 and stitching 119 also function to attach side strap 112 to pants 106.

Interior lining 128 is also affixed to the second side of pants 106 by stitching 125 and 132, both of which attach side strap 124 to pants 106. Interior lining 128 is also attached to the front and back interior of waistband 118. Specifically, interior lining 128 is attached by stitching 105 and 122 to the front interior area of waistband 118.

In this manner, when garment system 100 is being utilized to assist an elderly or handicapped person, interior lining 128 is securely attached to the interior of pants 106 and not only supports the user's buttocks area but is wide and firm enough to prevent a wedgie from forming.

Figure 1B:
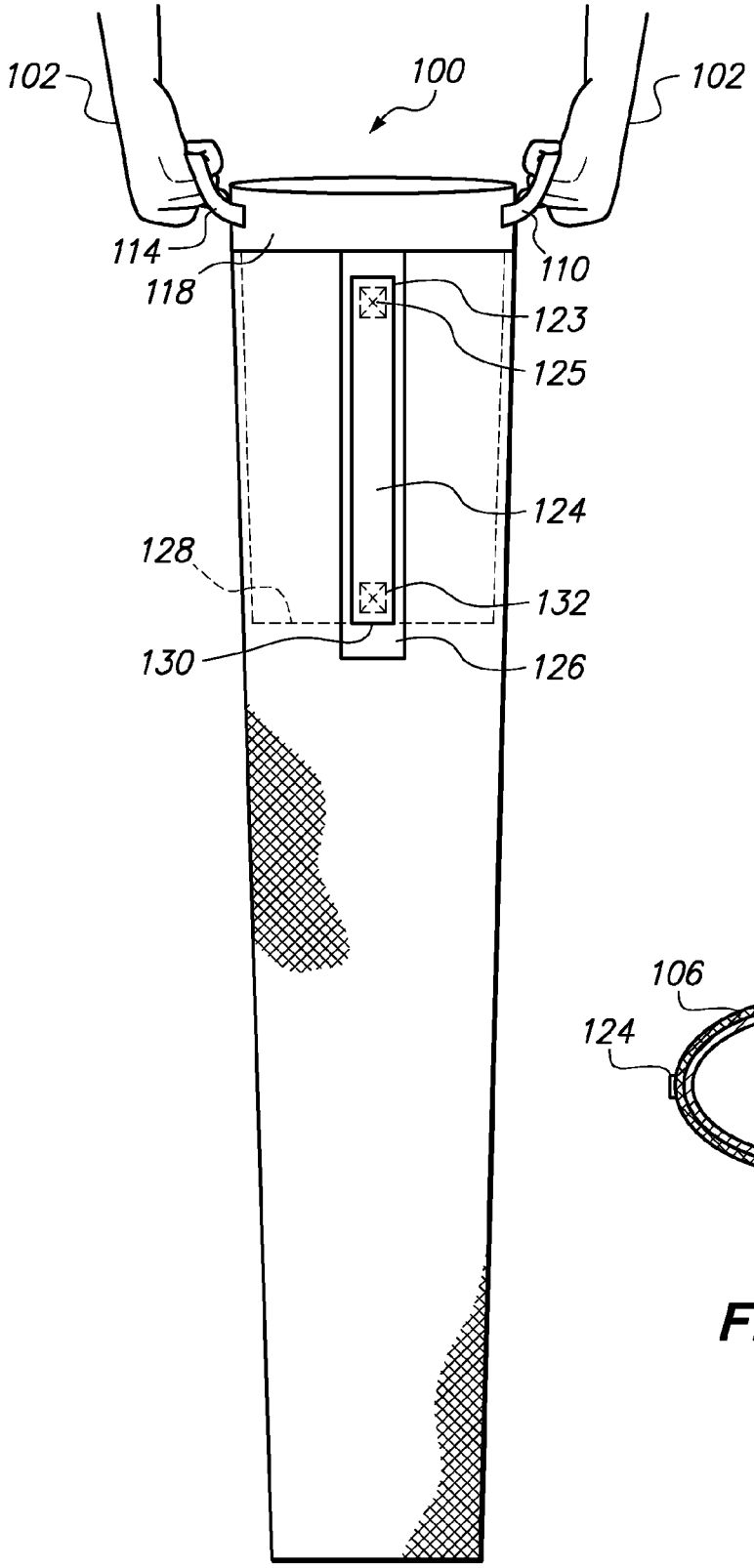
FIG. 1B is a side plan view of a garment system according to an exemplary embodiment of the present invention.

FIG. 1B is a side plan view of garment system 100 of FIG. 1A according to an exemplary embodiment of the present invention.

In FIG. 1B, front strap 110 and back strap 114 are illustrated. As can be seen, user helper 102 is grasping front strap 110 as well as back strap 114. Both front strap 110 and back strap 114 are securely and fixedly attached to waistband 118. In this manner, user helper 102 such as a caregiver for a handicapped person or a family member assisting an elderly parent can easily pick up such a handicapped or elderly person that is wearing pants 106.

User helper 102 need not grasp at any articles of clothing other than the straps provided on pants 106. The risk of injury to an elderly or handicapped person wearing pants 106 is minimized as the elderly or handicapped person is transported or relocated from one location to another.

As previously noted, front strap 110 and back strap 114 can be made of reinforced cotton fiber material or other comparable materials. However, one skilled in the art will realize that other alternative embodiments are possible. That is, straps 110 and 114 can be made of a polymeric material with two ends attached to waistband 118.

In FIG. 1B, a view of side strap 124 when observed from direction B of FIG. 1A is shown. As can be seen, side strap 124 (like side strap 112) is elongated and extends in a downwards direction from approximately waistband 118 to immediately below the lower hip area.

At first end 123, double stitching 125 is shown. Double stitching 125 securely attaches side strap 124 at its upper end. At its lower second end 130, side strap 124 is securely attached to pants 106 via a second double stitching 132 as shown. Not only is double stitching utilized, said double stitching is actually secured to pants 106 via reinforced area 126 as previously discussed with reference to FIG. 1A.

Reinforced area 126 is a piece of material that may be the same or different from the material with which pants 106 are made. Preferably, reinforced area 126 is made of a heavier durable material that is not prone to tearing or cannot easily be torn. Reinforced area 126 has a wider area relative to side strap 124 as shown.

Reinforced area 126 also extends from waistband 118 in a downward direction to immediately below the hip area of pants 106. It is also noted that interior lining 128 is also securely attached to reinforced area 126. In this manner, the entire unit is integratable as a single, strengthened unit that can hold the weight of an elderly or handicapped person during relocation.

Thus, in the embodiments of FIG. 1A and FIG. 1B, garment system 100 comprises two straps, two oppositely disposed side straps and two oppositely disposed front and back straps to assist user helper 102 with transporting or relocating an elderly or handicapped person.

Figure 1C:
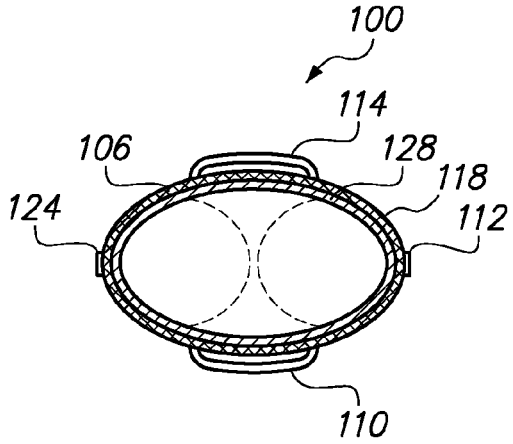
FIG. 1C illustrates a top plan view of a garment system when viewed from a direction C of FIG. 1A in accordance with an exemplary embodiment of the present invention.

FIG. 1C illustrates a top plan view of garment system 100 when viewed from a direction C of FIG. 1A in accordance with an exemplary embodiment of the present invention.

In FIG. 1C, front strap 110 and its oppositely disposed back strap 114 are shown. Similarly, side strap 112 and its oppositely disposed side strap 124 are also shown.

As can be seen, straps 110, 112, 114 and 124 are spaced around the waistband 118 of pants 106. By spacing said straps around, lateral and shear forces are evenly distributed along waistband 118. Also shown in FIG. 1C is a cross section of interior lining 128. As can be seen, this cross section indicates that interior lining 128 occupies the inner periphery of pants 106. Preferably, interior lining 128 is integratably secured to the interior of the straps as well as waistband 118. Use and operation of garment system 100 will now be described.

In FIGS. 1A-1C, user helper 102 wishing to physically assist an elderly or handicapped person that is wearing pants 106 begins by grasping at least two straps selected from front strap 110, back strap 114, side strap 112 and side strap 124.

Once at least two of said straps are grasped by user helper 102, the straps can be pulled in an upward direction to pick up the elderly or handicapped person. Among other advantages, the present invention allows elderly or handicapped users to wear garment system 100 as part of their daily clothing routine. Unlike other conventional systems such as physical assistance vests that can be bulky and uncomfortable for elderly or handicapped individuals to wear, garment system 100 is simple and more akin to everyday clothing worn by the individuals.

No special belts are required; no special contraptions are required, and such elderly or handicapped persons can wear garment system 100 for sleeping, for lounging or other everyday uses. As previously noted, all of the straps are fixedly and securely attached to pants 106 and are reinforced to prevent tearing that can be caused by lateral or shear forces.

Figure 2:
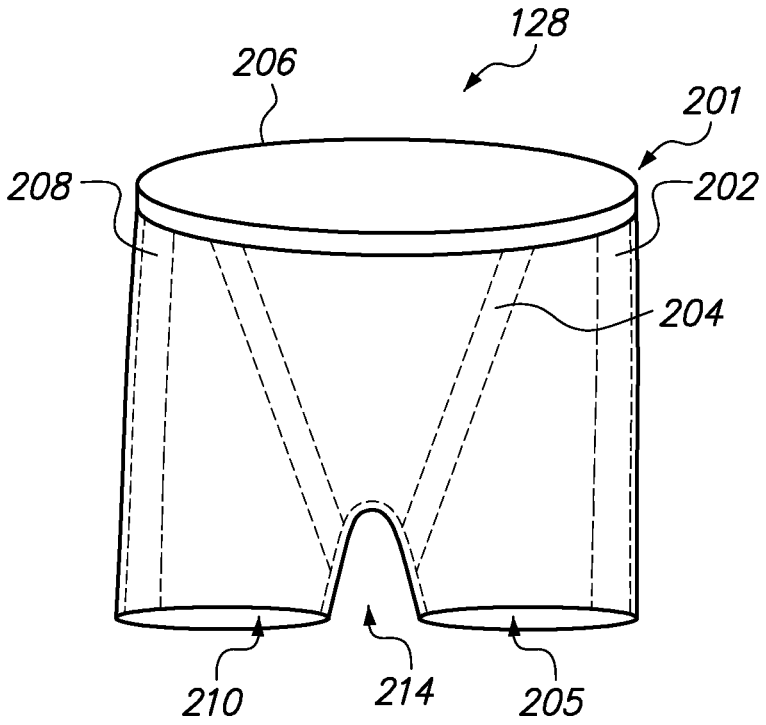
FIG. 2 illustrates an interior lining of FIG. 1A.

FIG. 2 illustrates interior lining 128 of FIG. 1A.

In FIG. 2, interior lining 128 might include a plurality of reinforced areas 202, 204, 206 and 208. In one embodiment, these reinforced areas provide frames for holding the mesh material of interior lining 128 upright. In a second embodiment, the reinforced areas can be employed for attaching interior lining 128 onto the interior surface of pants 106.

Reinforced area 202 extends from waistband area 201 of interior lining 128 downwardly and vertically to leg aperture 205. Likewise reinforced area 208 extends from waistband area 201 of interior lining 128 downwardly and vertically to leg aperture 210.

Reinforced area 204 runs diagonally from an intersection of waist area 201 and reinforced area 202 to bottom seam area 214 of interior lining 128. Reinforced area 206 runs diagonally from an intersection of waist area 201 and reinforced area 208 toward bottom seam area 214. As shown, bottom seam area 214 is itself reinforced and has a wide area that is at least preferably 1 to 3 inches wide to form a support base and prevent a wedgie from occurring when an elderly or handicapped person is being moved.

Figure 3A:
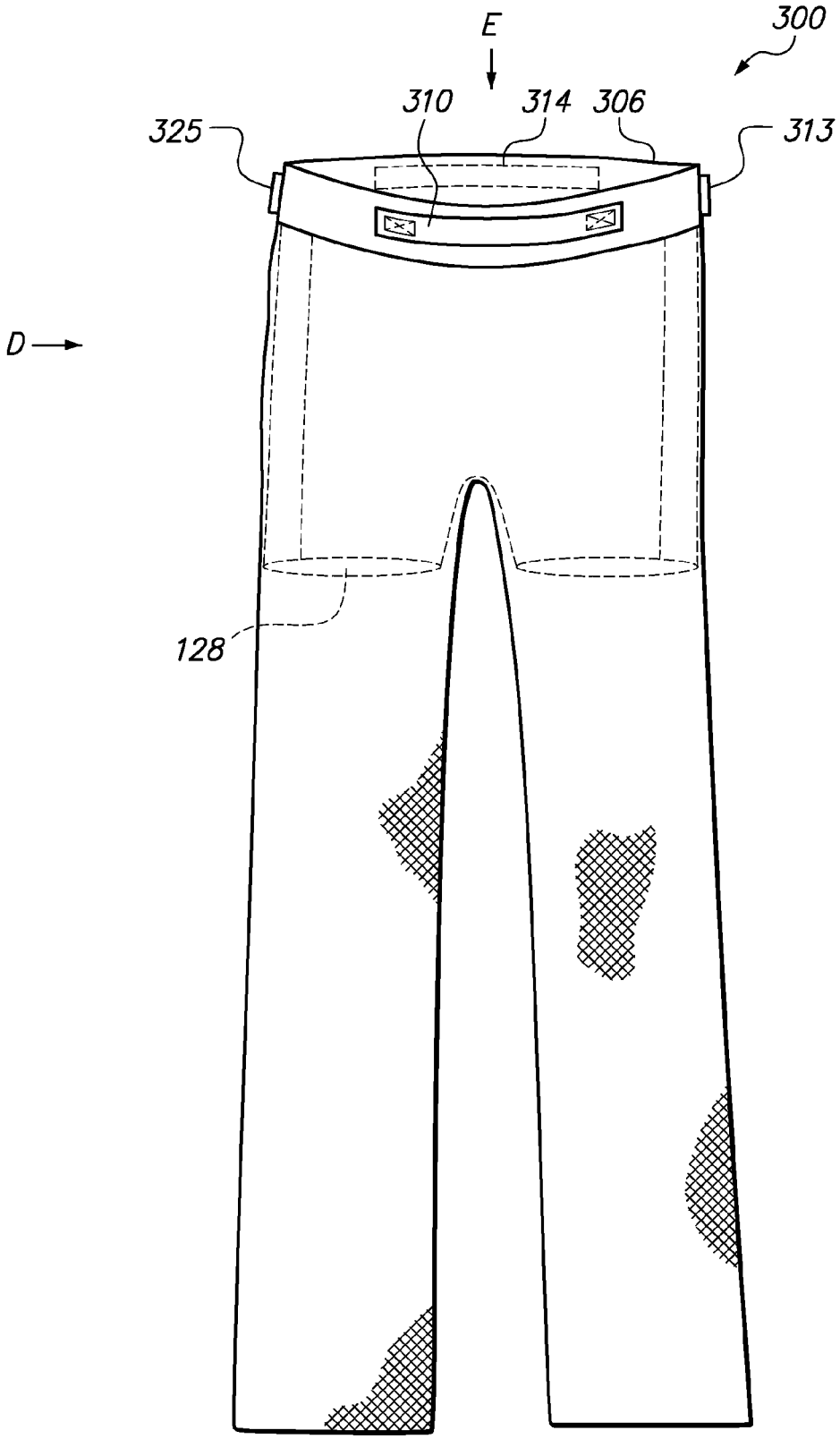
FIG. 3A illustrates a garment system according to an exemplary embodiment of the present invention.

FIG. 3A illustrates garment system 300 according to an exemplary embodiment of the present invention.

In FIG. 3A, garment system 300 includes pants 306, front strap 310 and back strap 314 (indicated by hashed lines) that are similar to correspondingly referenced numbers of FIG. 1A. Unlike the embodiment of FIG. 1A, garment system 300 includes side waistband strap 313 and an oppositely disposed side waistband strap 325 as illustrated in FIG. 3B but does not include side straps (e.g. 112, 124 of FIG. 1A).

Figure 3B:
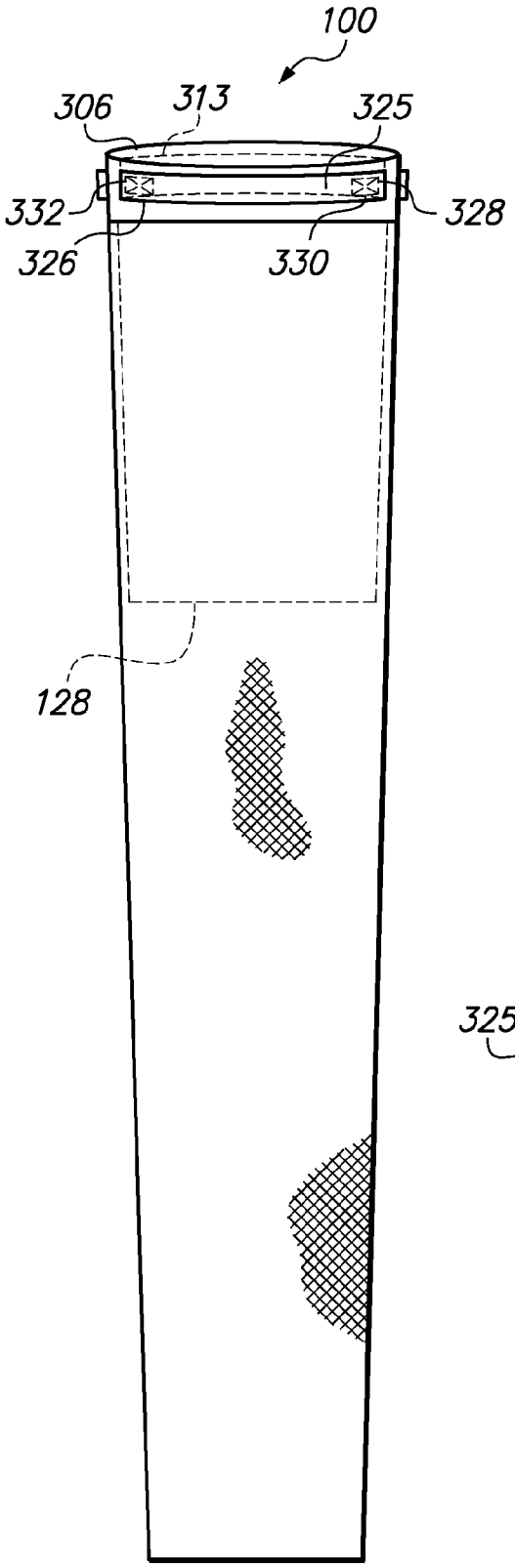
FIG. 3B is a side plan view of a garment system of FIG. 3A.

FIG. 3B is a side plan view of garment system 300 of FIG. 3A.

In FIG. 3B, garment system 300 is shown having side waistband strap 325 as viewed from direction D of FIG. 3A. As can be seen, side waistband strap 325 is elongated, running in a lateral direction from a first end 326 to a second end 328.

At a first end 326, side waistband strap 325 is securely attached to pants 306 via double stitching 332. At second end 328, double stitching 330 is used for attaching side waistband strap 325 to pants 306. In this manner, side waistband strap 325 and side waistband strap 313 can be used in conjunction and cooperatively with front strap 310 and back strap 314 for providing assistance to an elderly or handicapped patient.

Figure 3C:
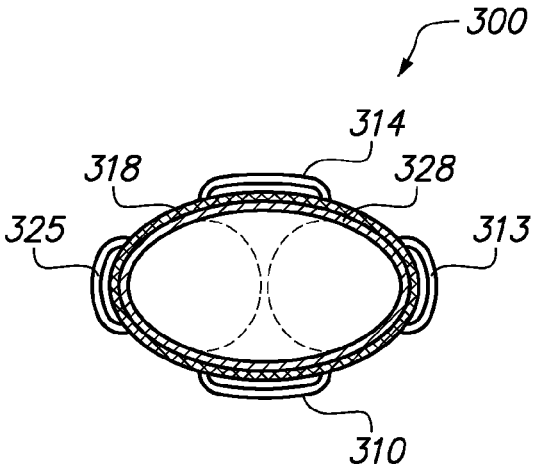
FIG. 3C illustrates a top plan view of a garment system when viewed from a direction E of FIG. 3A.

FIG. 3C illustrates a top plan view of garment system 300 when viewed from a direction E of FIG. 3A.

In FIG. 3C, both of the side waistband straps are more clearly illustrated. Specifically, side waistband strap 313 and its oppositely disposed side waistband strap 325 are shown in addition to front strap 310 and back strap 314. Interior lining 328 corresponding to interior lining 128 of FIG. 1A is also shown.

Here, note that side waistband strap 313, side waistband strap 325, front strap 310 and back strap 314 are spaced around waistband 318 to evenly distribute lateral and shear forces. In one embodiment, side waistband straps 313 and 325 are located so that a midpoint of each side waistband strap is substantially equidistant to front strap 310 and back strap 314.

A midpoint might be located at a distance that is one-half the length of each side waistband strap. The midpoint for side waistband strap 313 might be located halfway between the ends of side waistband strap 313. This midpoint is equidistant to the proximal edge of front strap 310 and to the proximal edge of strap 314.

Figure 4:
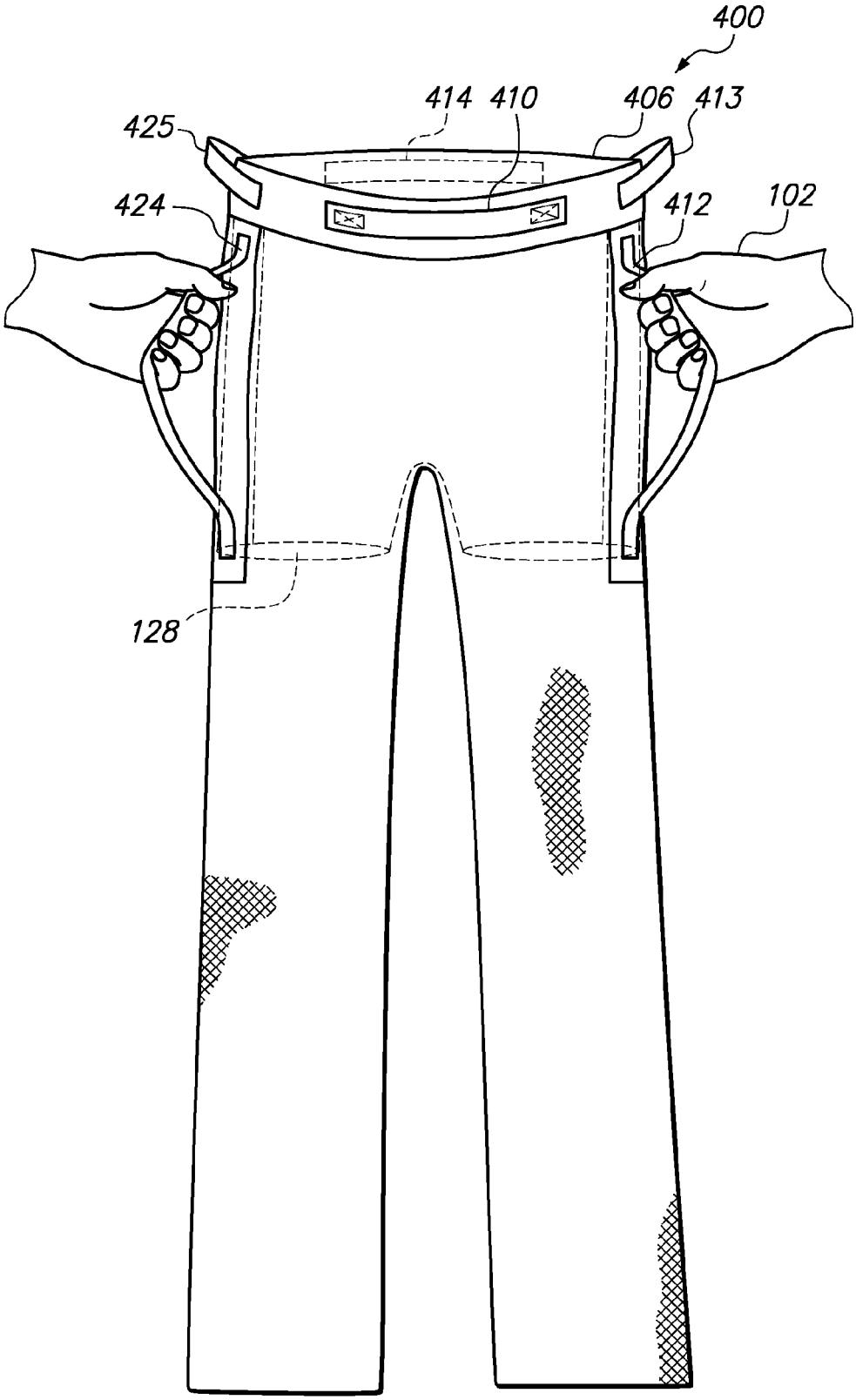
FIG. 4 illustrates a garment system in accordance with an exemplary embodiment of the present invention.

While the above is a complete description of exemplary specific embodiments of the invention, additional embodiments are also possible. For example:

FIG. 4 illustrates garment system 400, which is another additional embodiment in accordance with the present invention.

In FIG. 4, garment system 400 includes pants 406, front strap 410 and back strap 414 (indicated by hashed lines) that are similar to correspondingly referenced numbers of FIG. 1A. Unlike the embodiment of FIG. 1A, garment system 400 includes side waistband strap 413 and side waistband strap 425. Garment system 400 further includes side strap 412 and side strap 424 affixed to the sides of pants 406, side strap 412 and side strap 424 being similar to side strap 112 and side strap 124 of FIG. 1A.

As previously noted, the above is a complete description of exemplary specific embodiments of the invention; additional embodiments are also possible as shown above. Thus, the above description should not be taken as limiting the scope of the invention, which is defined by the appended claims along with their full scope of equivalents.

I claim:

1. A garment system for aiding a person that needs assistance with physical movement, said garment system comprising:

a pair of pants having a waistband encircling a waist portion of said pants;

a front strap having a first end and a second end, said first end and second end being secured to a front portion of said waistband, said front strap extending horizontally and sidewardly from said first end to second end along said front portion of said waistband; and a back strap having a first end and a second end, said first end and second end of said back strap being secured to a back portion of said waistband and said back strap being substantially oppositely disposed to said front strap, said back strap being spaced apart from said front strap, said back strap extending horizontally and sidewardly along said back portion of said waistband, wherein each of said front strap and said back strap is graspable by a helper to aid relocation of said person that requires assistance with physical movement.

2. The garment system of claim 1 wherein said front strap and said back strap are substantially aligned.

3. A garment system comprising:

a pair of pants having a waistband encircling a waist portion of said pants;

a front strap having a first end and a second end, said first end and second end being secured to a front portion of said waistband, said front strap extending horizontally and sidewardly from said first end to second end along said front portion of said waistband;

a back strap having a first end and a second end, said first end and second end of said back strap being secured to a back portion of said waistband and said back strap being substantially oppositely disposed to said front strap and aligned with said front strap, said back strap being spaced apart from said front strap, said back strap extending horizontally and sidewardly along said back portion of said waistband;

a first side strap having a first end and a second end secured to a first side area of said pants, said first side strap extending from said first end to said second end along said first side area; and a second side strap having a first end and a second end secured to a second side area of said pants, said second side strap being oppositely disposed to said first side strap, said second side strap extending from said first end to said second end along said second side area of said pants.

4. The garment system of claim 3 wherein said first side area is a hip area of said pants and said second side area is an oppositely disposed hip area of said pants.

5. The garment system of claim 3 wherein said first side area is a side of the waistband and said second side area is an oppositely disposed side of the waistband.

6. The garment system of claim 3 wherein said first side strap and the second side strap are attached to hip areas of said pants.

7. The garment system of claim 3 wherein said first side strap and the second side strap are attached to sides of said waistband.

8. A garment:

a pair of pants having a waistband encircling a waist portion of said pants;

a front strap having a first end and a second end, said first end and second end being secured to a front portion of said waistband, said front strap extending horizontally and sidewardly from said first end to second end along said front portion of said waistband;

a back strap having a first end and a second end, said first end and second end of said back strap being secured to a back portion of said waistband and said back strap being substantially oppositely disposed and aligned with said front strap, said back strap being spaced apart from said front strap, said back strap extending horizontally and sidewardly along said back portion of said waistband;

a first side strap having a first end and a second end secured to a first side area of said pants, said first side strap extending from said first end to said second end along said first side area;

a second side strap having a first end and a second end secured to a second side area of said pants, said second side strap being oppositely disposed to said first side strap, said second side strap extending from said first end to said second end along said second side area of said pants and an interior lining attached to an interior of said waistband, said interior lining extending downwardly from said interior of waistband to a lower crotch area of said pants.

9. The garment of claim 8 wherein said first side area is a hip area of said pants and said second side area is an oppositely disposed hip area of said pants.

10. The garment of claim 8 wherein said first side area is a side of the waistband and said second side area is an oppositely disposed side of the waistband.

11. The garment of claim 8 wherein the interior lining is fixedly attached to the first end and the second end of the first side strap.

12. An article of clothing comprising:

a pair of pants having a waist area for retaining said pants around a user's waist;

a front strap secured to a front portion of said waistband;

a back strap secured to a back portion of said waistband, said back strap being spaced apart from said front strap;

a first side strap having a first end and a second end secured to a hip area of said pants, said first side strap extending vertically and downwardly along said hip area;

a second side strap substantially oppositely disposed to said first side strap, said second side strap having a first end and a second end secured to a second hip area of said pants, said second side strap extending vertically and downwardly along said second hip area from said first end to said second end, and an interior lining secured to an interior portion of said waistband, said interior lining extending downwardly from said waistband to a lower crotch area of said pants.

13. The article of clothing of claim 12 wherein the interior lining is fixedly attached at the hip area to the first end and the second end of the first side strap.

14. The article of clothing of claim 12 wherein the interior lining is fixedly attached at the hip area to the first end and the second end of the second side strap.

* * * * *